US006286273B1

(12) United States Patent
Villela et al.

(10) Patent No.: US 6,286,273 B1
(45) Date of Patent: Sep. 11, 2001

(54) TILE VENT

(75) Inventors: Edward C. Villela, Leonia; Krishna Srinivasan, Mahwah, both of NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 09/593,712

(22) Filed: Jun. 14, 2000

(51) Int. Cl.[7] ..... F24F 7/02

(52) U.S. Cl. ..... 52/199; 52/57; 52/748.1; 454/365

(58) Field of Search ..... 52/198, 199, 57, 52/745.16, 747.1, 748.1; 454/365, 366

(56) References Cited

U.S. PATENT DOCUMENTS

| | | | | |
|---|---|---|---|---|
| 4,280,399 | | 7/1981 | Cunning . | |
| 4,325,290 | | 4/1982 | Wolfert . | |
| 4,558,637 | * | 12/1985 | Mason | 454/365 |
| 4,676,147 | | 6/1987 | Mankowski . | |
| 4,817,506 | | 4/1989 | Cashman . | |
| 4,903,445 | | 2/1990 | Mankowski . | |
| 5,092,225 | | 3/1992 | Sells . | |
| 5,095,810 | | 3/1992 | Robinson . | |
| 5,122,095 | | 6/1992 | Wolfert . | |
| 5,326,318 | | 7/1994 | Rotter . | |
| 5,457,920 | | 10/1995 | Waltz . | |
| 5,458,538 | | 10/1995 | MacLeod et al. . | |
| 5,651,734 | | 7/1997 | Morris . | |
| 5,713,158 | * | 2/1998 | Gibbs | 52/57 |
| 5,738,581 | * | 4/1998 | Rickert et al. | 454/365 |
| 5,740,634 | * | 4/1998 | Schade | 52/43 |
| 6,015,343 | | 1/2000 | Castillo et al. . | |

FOREIGN PATENT DOCUMENTS

WO 93/04323 3/1993 (WO) .

* cited by examiner

*Primary Examiner*—Beth A. Stephan
*Assistant Examiner*—Brian E. Glessner
(74) *Attorney, Agent, or Firm*—William J. Davis; Imre Balogh

(57) ABSTRACT

Tile vent for covering the opening of the ridge of an undulating roof. The tile vent includes two unitary panels facing each other in a mirror image fashion the top portion of which is affixed to a ridge board and the bottom portion of which is affixed to the undulating roof. The tile vent includes vent slots to allow exhaust of attic air, and reinforcing stiffeners to support ridge tiles placed over the opening in the ridge.

22 Claims, 5 Drawing Sheets

TILE VENT

BACKGROUND OF THE INVENTION

1. Field of the Invention

This invention relates to tile roof vents having undulating configurations. More particularly, the invention relates to roof ridge vents used on roofs having ceramic or metal tile coverings.

2. Reported Developments

Ventilators for attics of buildings are perforated or baffled vent openings in the underside of the eaves of an overhanging roof or facia and on the roof ridge overlaying the open roof along the length of the roof. The vent openings allow outside air to flow into the attic to equalize the interior attic temperature and pressure with that of the outside environment. This equalization helps to prevent degradation of the roof structure, reduces the accumulation of condensation in the insulating material covering the floor of the attic thereby increasing the efficacy of heating/cooling of the living space in the building covered by the roof structure.

The ventilator system of the prior art is typically comprising: a roof ridge ventilator and a soffit ventilator. The roof ridge ventilator overlays the open roof along the length of the roof for exhausting the air from the space below the roof and the ceiling of the attic, i.e., as the air entering the attic through the soffit vent mixes with the warmer air in the attic, it has to be expelled through an opening in the roof ridge where the lighter, warmer air accumulates. Desirably, the volume of air intake through the soffit ventilator should be balanced by the volume of air exhaust through the roof ridge ventilator. In an optimum soffit ventilator/roof ridge ventilator system there is a balance between the net free open area presented by such system. The terminology "Net Free Open Area" or NFA means the cross-sectional area of a ventilator system which is open for passage of air therethrough. This balance of the net free open area of a soffit ventilator and roof ridge ventilator is difficult to achieve. Thus in many existing and newly built buildings there tend to be an out of balance soffit/roof ridge ventilation system.

Ventilation systems should also provide against insects entering into the attic space of buildings. While large perforations in the soffit and roof ridge ventilation panels would render the desired flow of air through the attic space, they would also allow ingress to insects therein to form insect colonies.

In addition to having good ventilation of the attic space and preventing ingress of water, snow and insects into the attic space, the desiderata in a ventilation system includes: structural strength and stability to withstand the affects of the elements, such as high wind; strong structural support against collapse or warping, such as occurs by the accumulation of snow or ice or by the weight of the installers accidentally stepping on the roof ridge ventilator; easy handleability on installation; and low costs. In roof ridge ventilators designed for use on heavy roofing tiles made of slate, terra cotta, concrete, clay and metals, the roof ridge ventilator has to support the heavy ridge tiles in addition to snow and ice accumulating on the roof.

The present invention is directed to roof ridge vents which preferably are used in conjunction with an adequate soffit ventilator of the prior art.

Illustrative examples of the prior art directed to roof ridge ventilators are as follows.

U.S. Pat. No. 5,326,318 discloses a roof ridge ventilator for use with heavy roofing tiles. The ventilator comprises an elongated metal support member shaped as a hollow rectangular-section beam with the bottom of the beam open and skirt sections flared therefrom at the slope angle of the roof. The shape of the support member includes:

(a) a cap element anchoring and support portion running along the top of the hollow beam;

(b) two longitudinally oriented side walls containing vent openings therein, each wall connected to and depending vertically downward from the support portion; and (c) two longitudinally-oriented skirt portions conforming to the slope of the roof.

The cap element and side walls define a longitudinally oriented channel which contains an air-permeable material. The ventilating air passes through the air-permeable material and out of the vent openings.

WO 93/04323 discloses a roof vent of synthetic fiber matting constructed of randomly oriented synthetic fibers. In one embodiment for use with heavier slate or terra cotta tiles, the mat includes a grid pattern of small solid cores extending through the thickness of the mat. The mat is cut to length from a roll and installed over the ridge slot, with capping shingles or tiles nailed on top of it.

U.S. Pat. No. 5,651,734 discloses a ridge cap roof ventilator applied in roll form comprising a corrugated plastic sheet material.

U.S. Pat. No. 4,676,147 relates to a roof ridge ventilator comprising: a one piece cover member including a pair of flaps and a hinge unitary with the flaps to allow for installing the ventilator on roof ridges of different angles. Vents are located under the flaps. The vents also have an interior baffle structure to deflect air flow and to limit entry of foreign particles through the roof ridge.

U.S. Pat. No. 4,280,399 discloses a roof ventilator comprising a corrugated plastic sheet material which may be mounted transversely across any roof ridge regardless of its contours or roof angles.

U.S. Pat. No. 5,457,920 discloses a ridge top vent for roofs which vent includes grill portions flexibly located longitudinally along the lateral edges. The grill portions have at their distal end a set of flexible teeth adapted to fit on shingles and down between shingles in the gaps therebetween, so as to prevent passages between the grills and the shingles of any debris, insects or vermin.

U.S. Pat. No. 4,817,506 discloses a roof vent which includes a sheet-like cover having an inverted V-shaped cross-section. A pair of baffles are disposed on the lower surface of the cover and include a plurality of spaced partitions for supporting the baffles rigidly against the cover.

U.S. Pat. No. 5,095,810 discloses a roof ridge ventilation system comprising: a ridge vent composed of two panel portions joined together and forming an inverted V-shaped configuration which fits over the peak of the roof. A plurality of V-shaped baffles support the panels. Ventilation ribs are included extending downwardly from each side of the panels to allow passage of air into and out of the openings in the roof. An angled flange is also provided on both sides of the ridge vent to deflect air upwardly and over the roof to create negative air pressure which in turn helps to exhaust stagnant air from the attic space.

U.S. Pat. No. 5,458,538 discloses a roof vent comprising a onepiece plastic body. A plurality of transverse supports are provided for the one-piece plastic body. The system includes a wall to deflect entry of snow and rain. There are also drain openings to allow moisture to escape.

U.S. Pat. No. 6,015,343 discloses a tile roof vent for covering the opening of the ridge of an undulating tile roof. The vent includes two panels positioned on either side of the ridge board each of which has a hard plastic sheet with a lower portion and an upper portion. To the underside of the lower portion is affixed an air-permeable mat which conforms to the undulating configuration of the tile roof. The lower portions of the hard plastic sheets are reinforced by stiffeners and also contain vent holes for exhausting air from the attic space.

While this tile roof vent functions with good efficiency, we have discovered that the air-permeable mat on which the tile roof rests is compressed with time and it looses its capacity to allow air exhaust from the attic.

Although the prior art has provided various ventilation systems to address the desiderata, we have found that the balance of the Net Free Open Area for a soffit ventilator and roof ridge ventilator has not been quite adequately achieved for the reason that the roof ridge ventilators do not allow the passage of sufficient amounts of attic air to pass therethrough while preventing entry of snow, rain, ice and insects. Roof ridge ventilators designed for use with tile roof and having air-permeable vent material as water and insect barriers tend to be compressed by the heavy roof tiles thereby providing limited air circulation. Support structures to prevent compression or crushing of the air-permeable material are costly and difficult to install.

The present invention is directed to solve these problems in a tile roof vent, which is preferably used in conjunction with a soffit ventilator system of the prior art.

SUMMARY OF THE INVENTION

The present invention is directed to a tile vent for use in ventilating a building having a sloped roof which has an opening running longitudinally in its ridge portion. The angle determining the slope may vary from 20° of a relatively "flat roof" to 45–60° of a steep roof. Such variation in the angle of slopes is influenced by the building style, the size of the roof and weather conditions. A tile roof comprises sinusoidal, such as semi-circular or S-shaped tiles laid in rows running across the slope of the roof from the bottom edge of the roof toward the ridge of the roof. The rows are laid in alternating inverted and overlapped position to each other to form an undulating sequence of crests and valleys running from the bottom edge of the roof toward the ridge of the roof. The valleys serve as gutters to lead precipitation down from the ridge toward the bottom edge of the roof. The top row of tiles are omitted on each side of the ridge in order to create a gap or opening in the ridge to provide for ventilation of the air from the attic space. This gap or opening is to be covered by a tile roof vent to prevent entry of moisture and insects.

The present tile vent is placed onto the top row of tiles on each side of the ridge to cover the gap or opening in the ridge. The profile of the tile vent assumes the same undulating configuration as the top row of tiles on each side of the ridge. Because of conformance to the tile row configuration, the tile vent of the present invention has a low profile and is hardly visible from a distance. The tile vent comprises two hard plastic or metal sheets or panels having a top surface and a bottom surface, and are, in a top plan view, generally rectangular configuration. The two hard plastic or metal sheets or panels are mirror images of each other when placed over the gap or opening of the roof ridge. Reference made herein to one is relevant to the other as well.

Each of the hard plastic or metal sheets or panels comprises an elongated, sinusoidal body having:

- a transverse first end and a transverse second end;
- a top portion and a bottom portion running longitudinally and parallel to each other;
- an upper or edge rim of sinusoidal configuration integral with said elongated sinusoidal body adapted to conform to a vertical ridge board and to be affixed thereto;
- a lower body or edge seal lip, integral with said elongated sinusoidal body, of horizontal, flat configuration adapted to be placed and adhered to the tile roof;
- a central portion between the upper edge or rim and the lower edge seal lip constituting the main body portion of the hard plastic sheet or panel comprising:
  - alternating ridges of dome-shape configuration, and valleys of flat configuration serving as gutters between the dome-shape portions, integral with each other and smoothly merging into each other to conform to a sinusoidal configuration matching the sinusoidal configuration of the underlying roof tiles;
  - a plurality of vent slots in the alternating ridges of dome-shape configuration serving as outlets for exhaust air from the attic space; and
  - at least one reinforcing or stiffening rod, and preferably two or more reinforcing or stiffening rods, to render strength and rigidity to the tile vent.

The method of installing the tile vent of the present invention comprises the steps of:

(a) installing sinusoidal such as semi-circular or S-shaped tiles in rows running across the slope of the roof from the bottom edge of the roof toward the ridge of the roof, omitting the top row of tiles on each side of the ridge, wherein said rows of sinusoidal such as semi-circular or S-shaped tiles are being laid in alternating inverted and overlapping position to each other to form an undulating sequence of crests and valleys running from the bottom edge of the roof toward the ridge of the roof, said valleys serving as gutters to lead precipitation down from the ridge toward the bottom edge of the roof;

(b) positioning the two unitary panels in a face-to-face relationship over the opening in the ridge so that the lower portions of the panels rest on the uppermost top rows of the undulating roof tiles and their crests and valleys conform to that of the roof tiles;

(c) affixing the lower portions of the panels to the roof by cementitious means, such as thermoplastics;

(d) affixing the upper edge rim of the panels to the vertical ridge pole by nails or other fasteners, such as staples or adhesives;

(e) positioning ridge tiles over the tile roof so that:
  (1) the ridge tiles are aligned longitudinally over the tile roof vent and in an overlapping relationship to each other; and
  (2) the ridge tiles are supported at their center portion by the ridge board, and the leading edges of the ridge tiles rest on the reinforcing stiffener which runs above and not covering the vent slots;

(f) affixing the ridge tiles at their center portion to the ridge board and to the reinforcing stiffener by cementitious means.

BRIEF DESCRIPTION OF THE DRAWINGS

In the drawings, like numerals indicate like elements and primes (') indicate counterparts of such like elements.

DETAILED DESCRIPTION OF THE INVENTION

Figure 1:
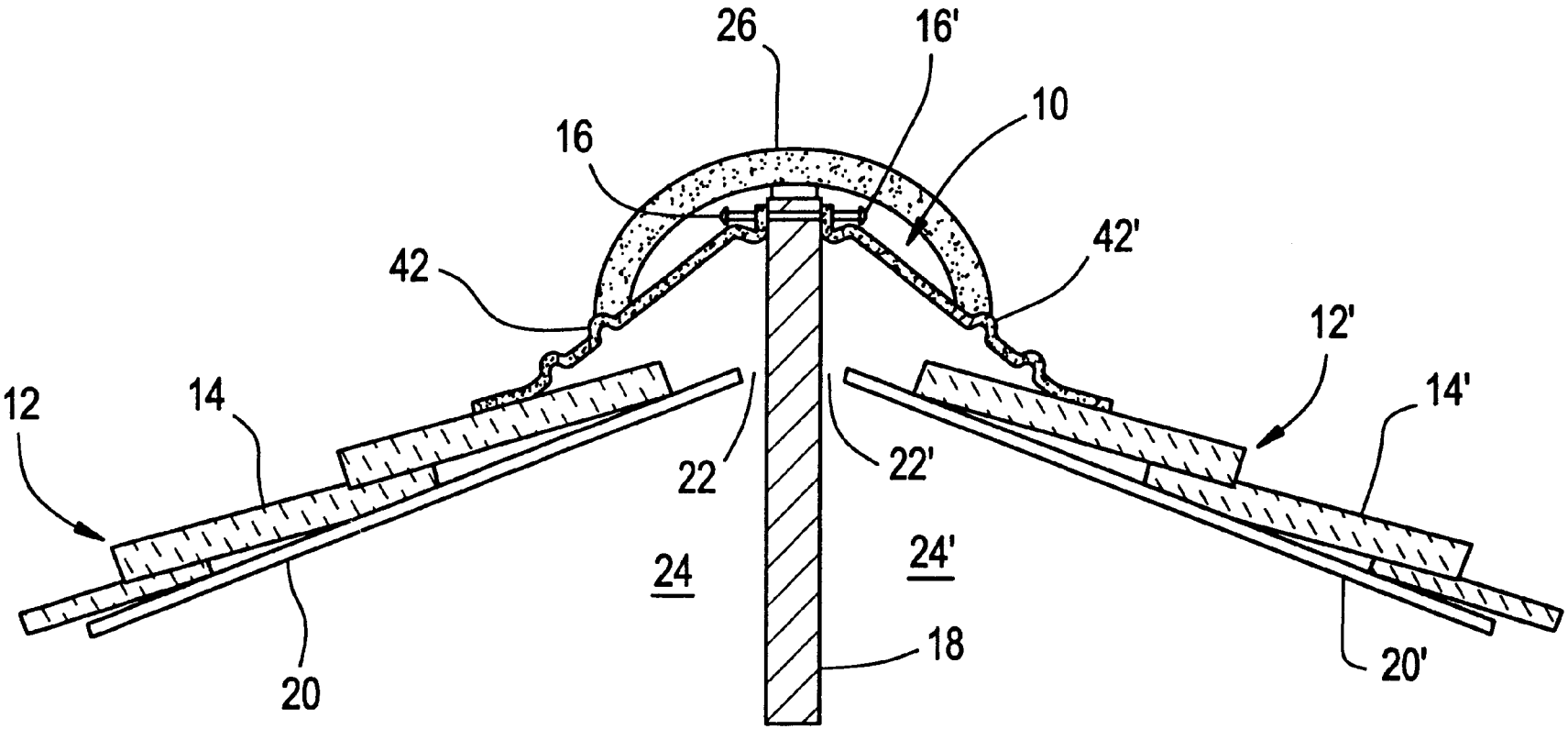
FIG. 1 is a cross-sectional view of a portion of roof ridge showing the tile roof vent of the present invention positioned over the roof ridge having an opening therein and covered by ridge tiles.

FIG. 1 is a cross-sectional view of a portion of a roof ridge showing the tile vent of the present invention designated generally as 10. The tile vent is described in relation to sloped roof 12 and 12', covered with metal or ceramic tiles such as terra cotta tiles 14 and 14' of generally semi-circular or S-shape configuration. The tiles overlap each other and form ridges and valleys which are parallel to the slope of the roof directing the flow of precipitation from the roof ridge downward to a gutter. The ridges and valleys form an undulating sequence characteristic of tile roofs. Sloped roof 12 and 12' comprise: a ridge board 18 to which rafters are attached by nails (not shown) or other suitable means; plywood decking or sheathing 20 and 20'; and roof tiles 14 and 14' laid over the sheathing in an overlapping relationship to one another. The plywood decking and the roof tiles on the plywood decking do not completely cover roof 12 and 12'; at the ridge of the roof there are gaps or vent slots designated by the numerals 22 and 22' which serve as exits for air in the attic space 24 and 24'. The gaps exist between each pair of rafters defining a continuous space under the peak of the roof so that the attic air can be vented to the outside. While the gaps would provide for maximum ventilation of the attic space, they would allow entry of rain, snow, insects and debris into the attic space. To prevent such entry, as well-known in the art, a ridge vent covers the gaps and at least partially overlaps the roof tiles on the plywood deck. The overlap insures that precipitation does not migrate toward the peak of the roof and does not enter into the attic space. The ridge of the roof over the tile vent is covered by ridge or cap tiles 26.

The present tile vent 10 covers the gaps at the peak of the roof and provides for proper ventilation of attic space 24 and 24' while preventing entry of moisture and insects thereinto without substantially affecting the ventilating capability of the gaps if left uncovered. The tile roof vent 10 is secured to the ridge board 18 by roofing nails 16 and 16' or other securing means.

The present invention will be described in connection with undulating rows of ceramic tiles, such as terra cotta tiles, as the preferred roof covering material. However, the invention can be practiced in conjunction with other undulating rows of tiles, panels or shingles made of synthetic material, wood, and metal such as steel, aluminum and copper. These metal roofs are typically coated with earthtone granules and with a final paint coat of polymer materials. The granules and/or the final paint coat may be of various colors. Copper is most revered and expensive roofing material having many advantages over other roofing materials. It weathers to a beautiful green patina which protects the surface from further oxidation. It is light weight; cools faster on summer evenings, whereas regular asphalt shingles hold the heat much longer. Copper and aluminum roofing is made from recycled materials and therefore are environmentally desirable. We prefer the use of terra cotta tiles for reason of their roof insulating properties and their relatively low cost.

Figure 2:
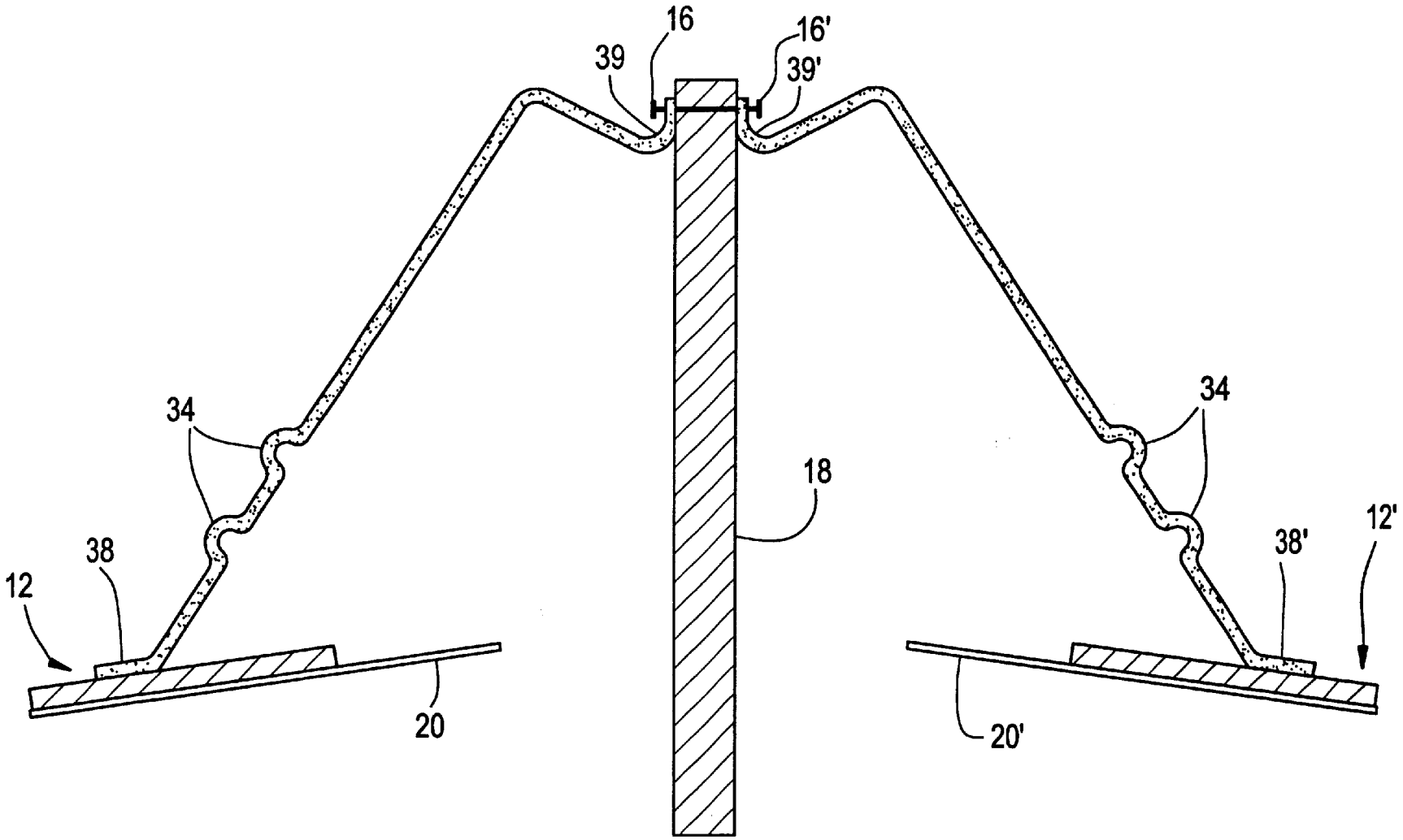
FIG. 2 is an enlarged cross-sectional view of the tile vent of the present invention showing its attachment to a ridge board at one end and laid over the tile roof at the other end.

FIG. 2 is an enlarged cross-sectional view of the tile vent shown in FIG. 1 showing the attachment of the tile vent to a ridge board at one end and laid over the tile roof at the other end. Stiffeners 34 and 34' provide strength to the tile vent. As shown in FIG. 1, ridge tiles 26 are supported by ridge board 18 at the central portions of the ridge tiles, and they lay on the sloped roof 12 and 12' with their leading ends. Preferably, the leading ends of the ridge tiles rest on stiffeners 34 and 34' leaving the lower portions containing vent slots 36 open free to allow attic air to exhaust therethrough.

Figure 3:
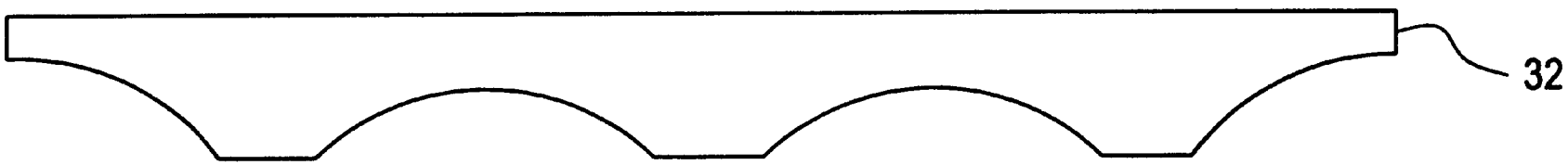
FIG. 3 is a side-elevational view of the tile vent.

FIG. 3 is a side-elevational view of one of the plastic panels constituting one side of the tile vent, the other side being the mirror image thereof.

Figure 4:
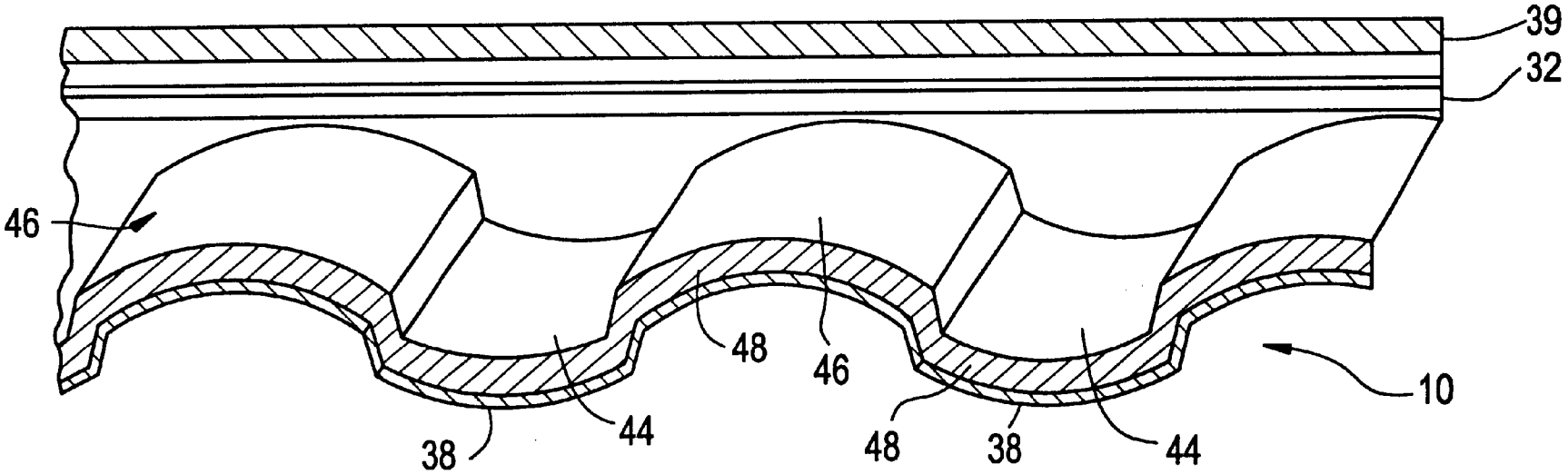
FIG. 4 is a perspective view of a portion of the left side of the tile vent, the right side being a mirror image of the left side of the tile vent.

FIG. 4 is a perspective view of a portion of the left side of the tile vent, the right side being a mirror image thereof. The perspective view illustrates the sinusoidal configuration having a dome shape portion 46 and a gutter portion 44 which match the sinusoidal configuration of the tiles on the sloping part of the roof. Vertical baffle 48 running longitudinally along dome-shape portion 46 and gutter portion 44 merge into edge seal lip 38.

Figure 5:
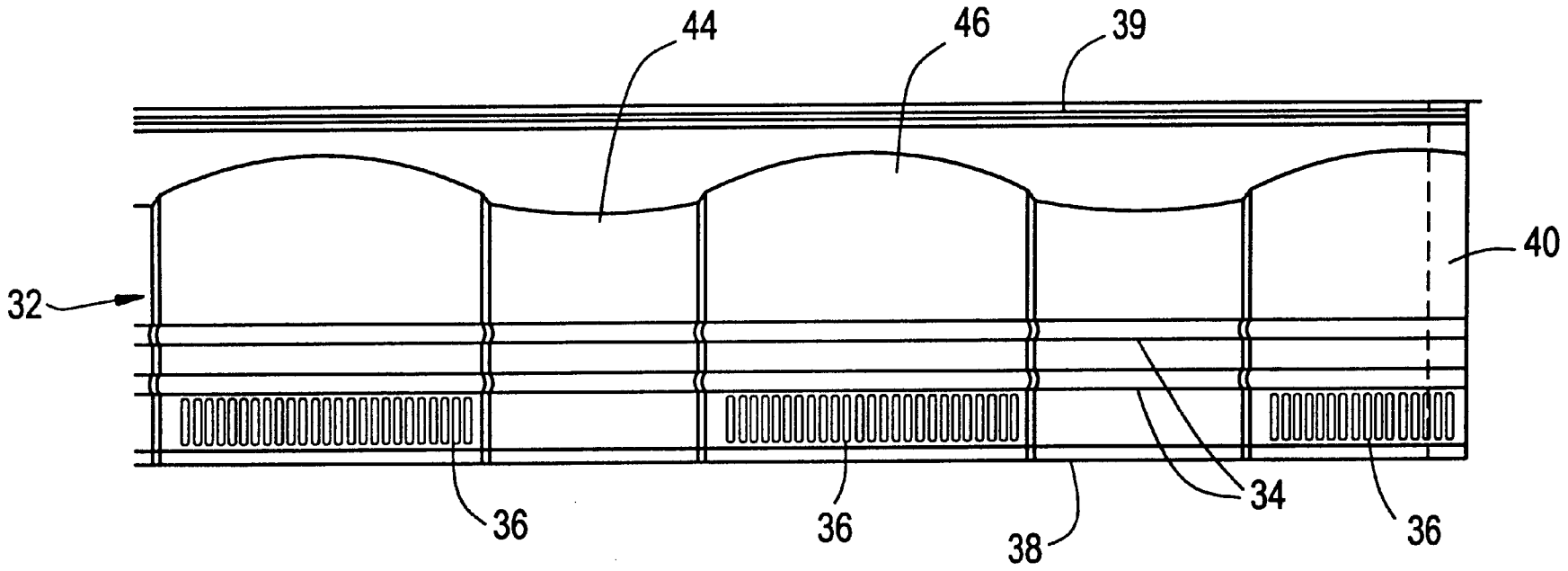
FIG. 5 is a top plan view of the tile vent showing the stiffeners and vent slots.

FIG. 5 is a top plan view of the tile vent of the present invention wherein the numeral 36 denotes vent slots, the numeral 34 denotes stiffeners, the numeral 38 denotes an edge lip, and the numeral 40 denotes overlap clearance. Stiffeners 34 are preferably of dome-shape configuration and serve to strengthen the panel against the weight of the ridge tiles 26. The stiffeners run parallel to each other and in a longitudinal direction of the panel. FIG. 5 shows two stiffeners, however, more than two stiffeners may be incorporated into panel 32 and at least one stiffener must be present. Edge rim 39 on the top portion of the panel is attached to ridge board 18 by nails 16 and 16' as shown in FIGS. 1 and 2, while edge lips 38 and 38' lay on sloping roof tiles 14 and 14'. Ridge tiles 26 are laid over tile vent 10 and is supported at center portions thereof by ridge board 18 and one of the longitudinally running stiffeners 34 and 34' at their edge portions 42 and 42'. To securely hold ridge tiles 26 to ridge board 18 and to stiffeners 34 and 34', a cementitious material such as adhesives and thermoplastics may be used.

Vent slots 36 are located at the lower portion of hard plastic or metal panel 32, between stiffener 34 and edge seal lip 38, in the dome shape portion 46 of hard plastic or metal panel 32. Gutter portion 44 remains free of vent slots for allowing free flow of precipitation down from the peak of the roof towards the bottom edge of the roof. Typically, the sloped roof at its bottom edge is equipped with a horizontal gutter (not shown) which collects and leads the precipitation away from the sloping roof into a vertical gutter and away from the building structure.

A plurality of vent slots provides ventilation of the attic air to the outside. The dimensions of the vent slots allow air to escape from the attic but prevents entry of insets into the attic space. The vent slots are positioned in vertical direction in the dome-shaped portions of the hard plastic panels and typically have a length of about 1.0 cm to 1.125 cm and a width of about 0.125 cm with vertical spacing of about 0.125 cm between the slots. The panels, typically having a length of about 37", on installation are put together end-to-end in an overlapping fashion, the overlapping portion 40 is shown in FIG. 5 for one of the panels.

The hard plastic panel or metal 32 is made of well known polymeric materials including polyethylene;

polypropylene;

polyvinyl chloride;

nylon,
polystyrene;
polyester;
natural rubber;
acrylate-butadiene rubber;
cis-polybutadiene;
chlorobutyl rubber;
chlorinated polyethylene elastomers;
polyalkylene oxide polymers;
ethylene vinyl acetate;
fluorosilicone rubbers;
hexafluoropropylene-vinylidene fluoride-tetrafluoroethylene terpolymers;
butyl rubbers;
polyisobutene;
synthetic polyisoprene rubber;
silicone rubbers;
styrene-butadiene rubbers;
tetrafluoroethylene propylene copolymers; and
thermoplastic-copolyesters; or of metal, such as aluminum, copper, brass or galvenized steel.

The panels are in the form of single unitary piece delivered to the site of installation and can be cut to the desired length using tools well known in the construction industry. The materials being thermoformable are preferred inasmuch as they are easily manufactured at a low cost.

In contradistinction to the tile roof vent disclosed in U.S. Pat. No. 6,015,343, no air-permeable layer is used under the hard plastic or metal panel which may be compressed by the heavy ridge tiles placed on the tile roof vent thereby rendering the tile roof vent less effective with the passage of time.

Having described the invention with reference to its preferred embodiments, it is to be understood that modifications within the scope of the invention will be apparent to those skilled in the art.

What is claimed is:

1. A tile vent for covering a ridge of an undulating flat through high profile tile roof, said ridge having an opening therein for allowing ventilation of static air from an attic space of a building, said tile vent comprising:

two unitary panels adapted to be positioned over said and spaced from and project a mirror image of each other, wherein each of said panels comprises:

an elongated, generally sinusoidal body having:

a transverse first end and a transverse second end;

a top portion and a bottom portion extending longitudinally and parallel to each other from said transverse first end to said transverse second end;

an upper rim of sinusoidal configuration extending from said top portion adapted to conform to a vertical ridge board and be affixed thereto;

a lower seal lip extending from said bottom portion, having a horizontal, flat configuration projecting away from said elongated sinusoidal body adapted to be placed on said tile roof;

a central portion between said upper rim and said lower seal lip comprising:

alternating ridges of dome-shape configuration, and alternating valleys of flat configuration between said alternating ridges, said alternating ridges and said alternating valleys smoothly merging into each other to conform to a sinusoidal configuration;

a plurality of vent slots in the alternating ridges serving as outlets for exhaust air from the attic space; and at least one stiffener extending longitudinally in said elongated sinusoidal body to render strength and rigidity thereto.

2. The tile vent of claim 1 wherein said stiffener is of dome-shape configuration.

3. The tile vent of claim 1 wherein said elongated sinusoidal body contains a plurality of stiffeners therein.

4. The tile vent of claim 3 wherein said stiffeners are of dome-shape configuration.

5. The tile vent of claim 1 wherein said undulating flat through high profile tile roof is of ceramic material.

6. The tile vent of claim 1 wherein said undulating flat through high profile tile roof is of terra cotta.

7. The tile vent of claim 1 wherein said undulating flat through high profile tile roof is of slate.

8. The tile vent of claim 1 wherein said undulating flat through high profile tile roof is of metal.

9. The tile vent of claim 8 wherein said undulating flat through high profile tile roof is of steel, aluminum or copper.

10. The tile vent of claim 1 wherein said unitary panels are of a polymeric material selected from the group consisting of:

polyethylene;
polypropylene;
polyvinyl chloride;
nylon,
polystyrene;
polyester;
natural rubber;
acrylate-butadiene rubber;
cis-polybutadiene;
chlorobutyl rubber;
chlorinated polyethylene elastomers;
polyalkylene oxide polymers;
ethylene vinyl acetate;
fluorosilicone rubbers;
hexafluoropropylene-vinylidene fluoride-tetrafluoroethylene terpolymers;
butyl rubbers;
polyisobutene;
synthetic polyisoprene rubber;
silicone rubbers;
styrene-butadiene rubbers;
tetrafluoroethylene propylene copolymers; and
thermoplastic-copolyesters or a metal selected from the group consisting of aluminum, copper, brass and galvanized steel.

11. A method of installing a tile vent on a roof for covering a ridge of an undulating flat through high profile tile roof, said ridge having an opening therein for allowing ventilation of static air from an attic space of a building, said installation comprising the steps of:

(a) installing sinusoidal tiles in rows running across the slope of the roof from the bottom edge of the roof toward the ridge, wherein said rows of sinusoidal tiles are being laid in alternatingly inverted and overlapped position to each other to form an undulating sequence of crests and valleys running from the bottom edge of the roof toward the ridge of the roof, said valleys serving as gutters to lead precipitation down from the ridge toward the bottom edge of the roof;

(b) positioning two unitary panels over said opening, said panels being spaced from and projecting a mirror image of each other, wherein each of said panels comprises: an elongated sinusoidal body having:

a transverse first end and a transverse second end;

a top portion and a bottom portion extending longitudinally and parallel to each other from said traverse first end to said traverse second end;

an upper rim of sinusoidal configuration extending from said top portion conforming to a vertical ridge board;

a lower seal lip extending from said lower bottom portion, having a horizontal, flat configuration projecting away from said elongated sinusoidal body and placed on said tile roof;

a central portion between said upper rim and said lower seal lip comprising:

alternating ridges of dome-shape configuration, and alternating valleys of flat configuration between said alternating ridges, said alternating ridges and said alternating valleys smoothly merging into each other to conform to a sinusoidal configuration;

a plurality of vent slots in the alternating ridges serving as outlets for exhaust air from the attic space; and at least one stiffener extending longitudinally in said elongated sinusoidal body to render strength and rigidity thereto;

(c) affixing said lower bottom portion to the undulating roof by cementitious means;

(d) affixing the upper rim to the vertical ridge board by nails, fasteners, staples or adhesives;

(e) positioning ridge tiles having a center portion and lead edges over the tile vent and tile roof so that:

(1) the ridge tiles are aligned longitudinally over the tile vent and in an overlapping relationship to each other; and (2) affixing the ridge tiles at their center portion to the ridge board and to said stiffener by cementitious means.

12. The method of claim 11 wherein said lead edges of said ridge tiles are cemented to a stiffener in said elongated sinusoidal body.

13. The method of claim 11 wherein said cementitious means is selected from the group consisting of thermoplastics and adhesives.

14. The method of claim 11 wherein said stiffener is of dome-shape configuration.

15. The method of claim 11 wherein said elongated sinusoidal body contains a plurality of stiffeners therein.

16. The method of claim 15 wherein said stiffeners are of domeshape configuration.

17. The method of claim 11 wherein said undulating flat through high profile tile roof is of ceramic material.

18. The method of claim 17 wherein said undulating flat through high profile tile roof is of terra cotta.

19. The method of claim 17 wherein said undulating flat through high profile tile roof is of slate.

20. The method of claim 17 wherein said undulating flat through high profile tile roof is of metal.

21. The method of claim 20 wherein said undulating flat through high profile tile roof is of steel, aluminum or copper.

22. The method of claim 11 wherein said unitary panels are of a polymeric material selected from the group consisting of:

polyethylene;

polypropylene;

polyvinyl chloride;

nylon, polystyrene;

polyester;

natural rubber;

acrylate-butadiene rubber;

cis-polybutadiene;

chlorobutyl rubber;

chlorinated polyethylene elastomers;

polyalkylene oxide polymers;

ethylene vinyl acetate;

fluorosilicone rubbers;

hexafluoropropylene-vinylidene fluoride-tetrafluoroethylene terpolymers;

butyl rubbers;

polyisobutene;

synthetic polyisoprene rubber;

silicone rubbers;

styrene-butadiene rubbers;

tetrafluoroethylene propylene copolymers; and thermoplastic-copolyesters or of metal selected from the group consisting of aluminum, copper, brass and galvanized steel.

* * * * *